US011279521B2

(12) United States Patent
Santos, III

(10) Patent No.: US 11,279,521 B2
(45) Date of Patent: Mar. 22, 2022

(54) SIP-HOLE IMPROVEMENT INSERT DEVICE

(71) Applicant: Alfred M. Santos, III, Beverly Hills, CA (US)

(72) Inventor: Alfred M. Santos, III, Beverly Hills, CA (US)

( * ) Notice: Subject to any disclaimer, the term of this patent is extended or adjusted under 35 U.S.C. 154(b) by 430 days.

(21) Appl. No.: 15/310,761

(22) PCT Filed: May 13, 2015

(86) PCT No.: PCT/IB2015/053507
§ 371 (c)(1),
(2) Date: Feb. 10, 2017

(87) PCT Pub. No.: WO2015/173738
PCT Pub. Date: Nov. 19, 2015

(65) Prior Publication Data

US 2017/0224139 A1 Aug. 10, 2017

Related U.S. Application Data

(60) Provisional application No. 61/992,913, filed on May 14, 2014.

(51) Int. Cl.
*B65D 47/08* (2006.01)
*B65D 25/48* (2006.01)
(Continued)

(52) U.S. Cl.
CPC ..... *B65D 25/48* (2013.01); *B65D 43/0212* (2013.01); *B65D 47/0828* (2013.01);
(Continued)

(58) Field of Classification Search
CPC ..... B65D 25/48; B65D 2231/022; B65D 47/0828; B65D 47/06; B65D 47/286; B65D 43/0212; B65D 2547/066
See application file for complete search history.

(56) References Cited

U.S. PATENT DOCUMENTS 2,796,205 A * 6/1957 Kuzma ..... B65D 47/06 222/464.1
5,228,603 A * 7/1993 Pham ..... B65D 47/04 222/479

(Continued)

OTHER PUBLICATIONS

International Search Report and Written Opinion from PCT Application No. PCT/IB15/53507, dated Jul. 7, 2016.

*Primary Examiner* — Don M Anderson
(74) *Attorney, Agent, or Firm* — Kali Law Group P.C.

(57) ABSTRACT

A insert device method and system that can prevent the undesirable spill and splash of sloshing liquids through the sip-hole a container and or the sip-hole of a lid, but yet still allow liquid to pass through the sip-hole. This is achieved by creating a tube or tubular flow-path or labyrinth flow-path device, with a inlet, and flange that could be secured to a sip-hole in efforts to direct and control the flow and rate of liquid from within a container. These elements can be combined with a tear-off seal, or plug to help to thwart and deflect sloshing liquid thereby minimizing or preventing the accidental release of liquid while still allowing the passage of liquid, and in some cases improving the flow of liquid. The addition of a removable seal or plug can allow the device to prevent liquid flow as desired.

9 Claims, 4 Drawing Sheets

(51) Int. Cl.
*B65D 43/02* (2006.01)
*B65D 47/28* (2006.01)

(52) U.S. Cl.
CPC ..... *B65D 47/286* (2013.01); *B65D 2231/022* (2013.01); *B65D 2547/066* (2013.01)

(56) References Cited

U.S. PATENT DOCUMENTS

| | | | | |
|---|---|---|---|---|
| D655,121 | S * | 3/2012 | Wallace | D7/300.2 |
| 2003/0006293 | A1* | 1/2003 | Lee | A47G 21/186 239/33 |
| 2003/0089714 | A1* | 5/2003 | Dart | B65D 43/0212 220/254.3 |
| 2004/0118847 | A1* | 6/2004 | Giraud | B65D 43/0208 220/254.3 |
| 2007/0012709 | A1* | 1/2007 | Durdon | B65D 43/0212 220/791 |
| 2007/0039960 | A1* | 2/2007 | Pawlik | B65D 51/18 220/254.7 |
| 2007/0075079 | A1* | 4/2007 | Stokes | B65D 81/3205 220/212 |
| 2012/0156345 | A1* | 6/2012 | Agarwal | B01F 5/0428 426/474 |
| 2012/0312827 | A1* | 12/2012 | Zuares | B65D 47/0804 220/713 |
| 2013/0292857 | A1* | 11/2013 | Connors | B01F 3/04241 261/30 |

* cited by examiner

SIP-HOLE IMPROVEMENT INSERT DEVICE

FIELD OF THE INVENTION

The present disclosure relates generally to a device and system for preventing accidental splashing or spilling of sloshing liquid from a sip-hole on a container or its lid More specifically, to a sip-hole extension insert device for preventing accidental beverage spills or splashes from the open sip-hole on beverage containers and their lids; certain embodiments combine a tear-off and or removable plug combination to further limit liquid flow. Applications include containers or their lids such as those found on coffee cups at retail outlets such as Starbucks, 7/11, and Dunkin Donuts for hot or cold liquids. Additional applications of the invention also include containers, lids, liquids, and soups that are heated and often reheated multiple times, or reused.

BACKGROUND

People often purchase liquids in containers and then walk or drive to another distant location while attempting to consume the liquid. Despite the care and consideration during transport and consumption, unexpected jostling and shaking often occurs. This usually results in accidental splashing of the liquid from its container or lid. The previous scenarios are accentuated in the case of a full container, wherein even slight sloshing back and forth of the liquid results in the hot or cold contents splashing out of the sip hole, possibly causing a serious burn to the consumer. When the consumer is driving in a vehicle, a small splash of a hot beverage may cause a serious accident, a burn to the consumer, a stain to the consumer's clothing, or a stain in the upholstery of the vehicle.

Even in the best of situations where the consumer is sitting down or in a stationary position enjoying a liquid held within a container, it is common to experience some spillage from the container, it lid, and their sip-holes.

The use of sip-hole plugs or stoppers is costly, terrible for the environment, you need two hands to operate it, but worst of all, they prevent a person from enjoying their beverage until the plug is removed. For a driver this could have catastrophic results, because this means taking both hands off the steering wheel to begin this process. A smart driver might use only one hand to remove the plug, and then place it down somewhere else in their car where it might stain the car. At that point, the sip-hole is open again, and accidental spillage is very likely outcome. Other then consumption-less transport, the plug is not the best solution.

The use of straws to slow the spillage from sip holes is outright dangerous. Most people don't realize that drinking straws provided at stores are designed for cold beverages only, not for hot beverages. Regular drinking straws are made with cheaper plastics, whereas the smaller, little red and black "stirring straws" found in stores are made from a heat resistant sale plastic which do not leach toxic chemicals into your hot coffee or tea. These little straws are meant to be used as mixing sticks and to sample flavor. They are not meant to be used as drinking straws, this is why they are short, and the hole is purposefully designed to be extra small. Even if you couple three or four stirring straws, it makes for a messy and leaky drinking experience. Drinking hot beverages from drinking straws is toxic It is possible to find nontoxic "hot-safe" straws online, but they are not provided at local beverage shops and are generally constructed from glass.

There is a real need for a device that allows the consumer to drink from a container safely without requiring the consumer's head to tilt backward, as the container approaches the final sips, and does not result in a line of sight impediment, this is particularly true for people driving cars. Additionally, cups are generally more likely to leak at this point because the hot or cold liquid has usually softened and degraded the cup-lid seal, this particularly true along the cup crease.

These previous scenarios are compounded exponentially when there is no lid to prevent splashing or spilling of the liquid. The fast paced modern "to-go" lifestyle we live has become commonplace. As a result, drive-through food and, more importantly, drive-through beverage services are now an integral part of life. Therefore, there is a real and present need for a device that will prevent the splash of liquid through a sip-hole of containers and lids, but which does not prevent a person from safely drinking or enjoying the fluid both during transport or stationary scenarios.

Equally important, is the need to produce reliable, low cost, and environmentally friendly solutions for ail of these problems while still allowing a person to enjoy their liquid consumption no matter what sort of lifestyle they live.

SUMMARY

In accordance with an embodiment, it is an objective of this application to obviate or mitigate some disadvantages of existing solutions to the problems discussed within this application and others known otherwise.

In accordance with an embodiment, it is among an objective of this application to provide a system and device to prevent or minimize spillage and splash of sloshing liquids from containers, their lids, or their sips-holes, without obstructing flow of liquid from sip-holes.

In accordance with an embodiment, it is among an objective of this application to provide a system, a method, and a device to limit and or control fluid communication by illustrating an embodiment with a tube formed with a upper open end, a flange, at least one inlet. Other embodiments of the same device would include a seal or plug, that can block liquid and gas flow as desired. Certain embodiments this seal or plug would be of the pull, or tear off type, generally secured to top-side of flange.

In accordance with an embodiment, it is among an objective of this application to provide a system, and device to prevent or minimize spillage and splash of liquids from containers, their lids, or their sips-holes, while improving the flow of liquid from their sip-holes.

In accordance with an embodiment, it is among an objective of this application to provide a system, and device to prevent or minimize spillage and splash of liquids from containers, their lids, or their sips-holes, without stopping its sip or pour capabilities.

In accordance with an embodiment, it is among an objective of this application to provide a system, and device to prevent or minimize spillage and splash of liquids from containers, their lids, or their sips-holes, while on the go and in stationary scenarios.

In accordance with an embodiment, it is among an objective of this application to provide a system, and device to provide ease of use while consuming liquids from containers, their lids, or their sips-holes, in active and mobile scenarios one might encounter during transport.

In accordance with an embodiment, it is among an objective of this application to provide a system, and device to provide ease of use while consuming liquids from containers, their lids, or their sips-holes, in stationary scenarios.

In accordance with an embodiment, it is among an objective of this application to provide a system, and device to provide the ability to consume liquids from containers, their lids, or their sips-holes, without having to obstruct line of sight with the liquid container.

In accordance with an embodiment, it is among an objective of this application to provide a system, and device to provide the ability to consume liquids from containers, their lids, or their sip-holes, without having to tilt the liquid container as much as person might normally have to do so to consume the liquid inside.

In accordance with an embodiment, it is among an objective of this application to provide a system, and device, that provides the ability to consume liquids from containers, their lids, or their sips-holes, without having to tilt a liquid container as much as person might normally have to in efforts to better preserve the container/lid seal, and its crease for a longer duration of time, thereby reducing the likelihood of accidental spilling of liquid.

In accordance with an embodiment, it is among an objective of this application to provide a system, and device to provide the ability to consume liquids from a container, a lid, or its sip-hole as one might normally do, while adding the ability to suck the liquid through that same sip hole, by adding a tubular flow-path.

In accordance with an embodiment, it is among an objective of this application to provide a system, and device to provide the ability to consume liquids from a container, a lid, or its sip-hole as one might normally do, while adding the ability to suck the liquid through an added flow-path thereby increasing the flow of liquid for better, or more controlled consumption.

In accordance with an embodiment, it is among an objective of this application to provide a system, and device that provides the ability to prevent accidental splash of liquids from a container, a lid, or its sip-hole, while regaining the ability to consume the liquid without having to remove a plug, to access the liquid.

In accordance with an embodiment, it is among an objective of this application to provide a system, and device that provides the ability to prevent accidental splash of liquids from a container, a lid, or its sip-hole, while retaining the ability to consume the liquid, with one hand, to help improve safety in situations when a person might need to use their other hand, such as in the case of driving.

In accordance with an embodiment, it is among an objective of this application to provide a system, and device with at least one tubular flow-path which liquid can flow through.

In accordance with an embodiment, it is among an objective of this application to provide a system, and device with at least one vented flow-path, that liquid can flow through.

In accordance with an embodiment, it is among an objective of this application to provide a system, and device with a labyrinth flow-path so that liquid can flow through, but sloshing liquid could be deflected.

In accordance with an embodiment, it is among an objective of this application to provide a system, and device with at least one viscosity barrier on its sip-hole, or on its flow-path, capable of deflecting and containing sloshing liquid.

In accordance with an embodiment, it is among an objective of this application to provide a system, and at least one device that could reduce manmade waste made by companies or people when using liquid plugs or straws in sip-holes.

In accordance with an embodiment, it is among an objective of this application to provide a system, and at least one device that could reduce the amount of materials needed to construct standard sip-hole plugs, straws, and lids.

In accordance with an embodiment, it is among an objective of this application to provide a system, and at least one device that could reduce the manufacturing costs associated with standard splash devices used with liquid containers.

In accordance with an embodiment, it is among an objective of this application to provide a system, and at least one device that could be constructed, or partially constructed from edible materials.

In accordance with an embodiment, it is among an objective of this application to provide a system, and at least one device that could be constructed, or partially constructed from edible materials, that could degrade or dissolve after a period of uses, and at an appropriate time after it is no longer needed to prevent spillage.

In accordance with an embodiment, it is among an objective of this application to provide a system, and at least one device that could be constructed, or partially constructed from edible materials that could be added as flavor, sugar, or enhancement to a liquid.

In accordance with an embodiment, it is among an objective of this application to provide a system, and at least one device that could be constructed, or partially constructed from scented material.

In accordance with an embodiment, it is among an objective of this application to provide a system, and at least one device that could be constructed, or partially constructed from visual temperature/thermal changing material.

In accordance with an embodiment, it is among an objective of this application to provide a system, and at least one device that could be constructed to fit snugly in a container, its lid, or their sip-hole, to prevent or help reduce liquid spillage or splashing.

In accordance with an embodiment, it is among an objective of this application to provide a system, and a device that could be constructed to fit snugly in the sip-hole of a container, its lid, or their sip-hole by adding a groove or bevel to help secure it to fit perfectly snug with the sip-hole, or secure it in the sip-hole.

In accordance with an embodiment, it is among an objective of this application to provide a system, and device that could be inserted in the sip-hole of a beverage container or its lid, with an extended flow-path that could extend outwardly from the topside of container or its lid.

In accordance with an embodiment, it is among an objective of this application to provide a system, and device that could be used and reused again.

In accordance with an embodiment, it is among an objective of this application to provide a system, and a device that could have a built in flow-path, and or viscosity barrier, but which can still be stacked tightly for better packaging and distribution.

In accordance with an embodiment, it is among an objective of this application to provide a system, and a device with an angle cut into the base of its flow-path, the angled base added to improve its spill and splash prevention.

In accordance with an embodiment, it is among an objective of this application to provide a system, and a device with a bevel or ridge added to the inner side of its flow-path to help improve its spill and splash prevention.

In accordance with an embodiment, it is among an objective of this application to provide a system, and a device with an angled flow-path to help improve its spill and splash prevention.

In accordance with an embodiment, it is among an objective of this application to provide a system, and a device that can work with an attached plug to prevent liquid from passing through its flow-path.

In accordance with an embodiment, it is among an objective of this application to provide a system, and a device that can be inserted into a sip-hole of a liquid container or its lid, to prevent spill or splash, while still allowing the liquid to be consumed through its flow-path, and with a plug that could prevent liquid from passing through its flow-path.

In accordance with an embodiment, it is among an objective of this application to provide a system, and a device that can be inserted into a sip-hole of a liquid container or its lid that could widen the sip-hole to allow more liquid to pass through faster.

In accordance with an embodiment, it is among an objective of this application to provide a system, and a device that can be inserted into a sip-hole of a liquid container or its lid, and have an adhesive agent capable of securing it in place.

In accordance with an embodiment, it is among an objective of this application to provide a system, and a device that can be inserted into a sip-hole of a liquid container and having a locking mechanism capable of securing it in place, to either one or both, the sip-hole, and or the container lid.

In accordance with an embodiment, it is among an objective of this application to provide a system, and a device that can be inserted into a sip-hole of a liquid container and having a mechanism capable of preventing chocking.

In accordance with an embodiment, it is among an objective of this application to provide a system, and a device that combines the benefits a sip-tube and a plug together, so that they can be inserted with container or its lid, to prevent sloshing liquid from splashing out from a sip-hole.

Aspects of the present application overcome the above identified and other problems of the related while preventing spills of liquids from containers or their lids without restricting adequate flow of liquid for consumption or otherwise.

In accordance with an embodiment, it is among an objective of this application to provide a system, and device which combines the benefits a sip-hole insert and the benefits of plug into one device, to achieve maximum splash protection.

In accordance with an embodiment, it is among an objective of this application to provide a system, and a device that combines the benefits a sip-tube and a slid cable plug together, to achieve maximum splash protection.

Among other things, variations of devices and systems of use in accordance with aspects of the present application would reduce the proliferation of non-biodegradable or less biodegradable items now commonly inserted into coffee cup and other beverage lids to prevent spills such as sip-hole plugs or straws, in accordance with aspects illustrated herein, device embodiment variations may be used to prevent liquids from spilling from the small opening sip-hole typically found in the top of lids that are typically used to cover containers sold at various establishments.

BRIEF DESCRIPTION OF THE DRAWINGS

Four (4) drawing sheets with 21 Figures.

DETAILED DESCRIPTION

Figure 1:
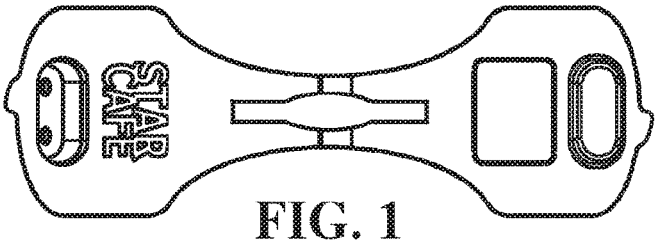
FIG. 1 is a top down view of embodiment of the present invention.

The foregoing aspects, features and advantages of the present application will be further appreciated when considered with reference to the following descriptions of a few preferred embodiments and accompanying drawings, wherein like reference numerals represent like elements. In describing the preferred embodiments of the invention illustrated in the appended drawings, specific terminology will be used for the sake of clarity. However, this application is not intended to be limited to the specific terms used, and it is to be understood that each specific term includes equivalents that operate in a similar manner to accomplish a similar purpose.

Figure 5:
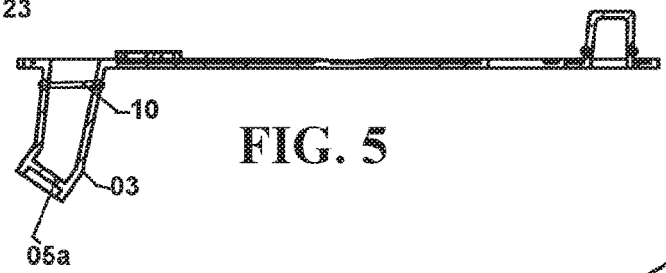
FIG. 5 is a cross section view of an embodiment with an angled flow-path.

We will start our detailed description by examining FIG. 5. FIG. 5 is a cross section illustration of a hollow, angled, vented, tubular flow-path, sip-hole extension and plug combination insert device, aka "sip-tube" for short reference. Sip-tubes can vary in size, shape, and design, but in use they achieve similar benefits. Some sip-tubes are simple hollow tubes that are designed to be secured to a sip-hole found on a container, or its lids, in efforts to extend the sip-hole. The sip-tube-plug combination device not only extends the sip-hole of container or a lid, but it can also be used to plug the sip-hole when desired. The extended sip-hole, or sip-tube works by deflecting sloshing liquid, and directing the flow of liquid in a controlled and desired manner within its hollow flow-path, thereby limiting or thwarting undesirable or "accidental spill and splash" of liquid, aka "ASSL", for short reference.

In more detail, a sip-tube works be deflecting the sloshing liquid within the container when it's jostled, and by controlling the amount of liquid within the flow-path along with its direction and rate of flow, it also lessens the force excerpted by the slashing liquid in the container on the liquid after it enters the flow-path, thereby minimizing or preventing accidental spill and slash. The combination of the sip-tube and plug can eliminate all ASSL when the sip-tube-plug combo insert device is in a foldediclosed position, such as that illustrated in FIG. 6. 16 and FIG. 19.

Some overview benefits achieved by using a sip-tube-plug in conjunction with a container or lid are, but not limited to:

Benefits:

Lessens or eliminates accidental spill and splash (ASSL) from sip holes.

Adds suction ability to sip holes, which can increase liquid flow when desired.

Widens sip holes for faster consumption.

Allows a modern person with an active lifestyle to be able to enjoy a liquid just the same and a stationary person without having to worry about spill or splash.

Blocks dissipation of hot steam liquid which helps maintain heat longer while consuming hot liquids; thereby conserving desired temperatures, hot or cold.

Eco-conscious when compared to splash plugs, stir-sticks, and straws; less material, less waste, and they can be reused.

Can be constructed or partially constructed of edible materials that can flavor or enhance liquids.

Offers at least four ways to consume a liquid more safely: a; prevents line of sight blockage caused by containers and their lids because of sucking action, b; lessens spills which could cause burns, c; can consume liquids without the need of two hands like plugs need, d; less spill equals less distraction while conducting other potentially dangerous tasks such as driving.

Plug a sip-hole completely when desired.

Overall makes for a more enjoyable drinking experience.

The resulting benefits achieved from embodiment to embodiment vary slightly as additional features are added to the base hollow sip-tube. These additional features will be discussed in detail below. While other features might aide in deflecting a small or negligible percentage of sloshing liquids, we will discuss many of the features and their benefits.

Figure 2:
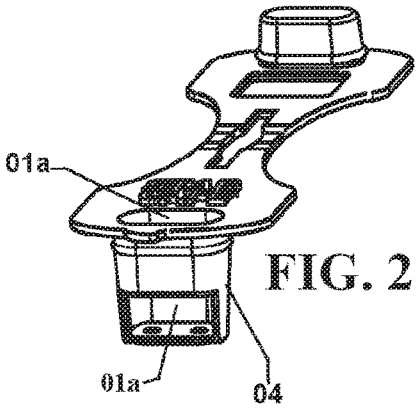
FIG. 2 is a tilted front to back view of a similar embodiment from FIG. 1.
Figure 3:
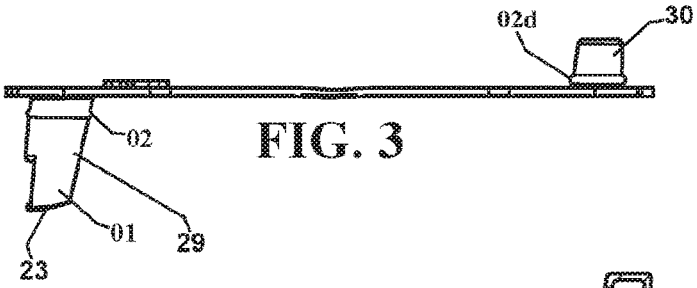
FIG. 3 is a side view of similar embodiment from FIG. 1.
Figure 10:
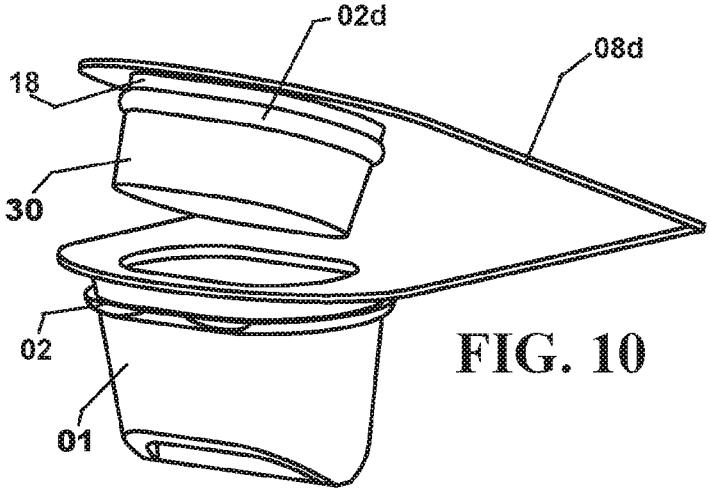
FIG. 10 is a front to back top side view of an embodiment of the present invention in the semi-folded position.
Figure 11:
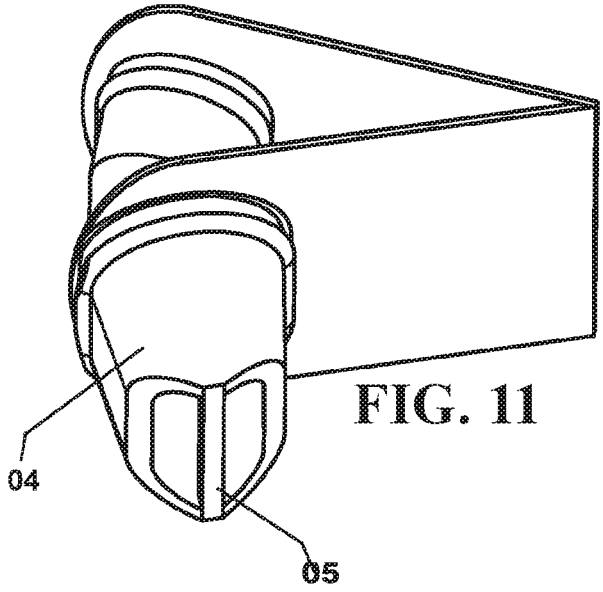
FIG. 11 is a tilted side view of an embodiment of the present invention in the semi-folded position.

FIG. 1 is a top down view of an embodiment disclosed within this application. FIG. 2 is a tilted front to back view of a similar embodiment from FIG. 1, it illustrates the extended sip-hole which protrudes in a downward direction, while plug element 30 is illustrated in FIG. 3, which protrudes in an upward direction. The insertion of plug element 30 into the hollow sip-tube or flow-path 01*a* as seen in FIG. 10 and FIG. 11 shows how the sip-tube is folded and set into a closed position. Once the plug is fully inserted into the hollow sip-tube as illustrated in FIG. 6, 7, 15, and FIG. 16, this becomes the folded and or closed position. This folded/closed position is used to eliminate and block, or plug ail ASSL. The plug could be designed to fit snugly in a secured position with the sip-tube. An additional extended protrusion 02*b* as illustrated on plug 30 in FIG. 3 and FIG. 10, can help to secure and seal the plug within the sip-tube.

Figure 18:
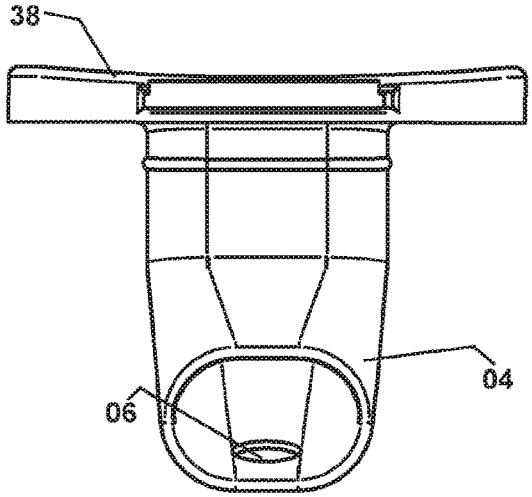
FIG. 18 is a front view of a similar embodiment to FIG. 17.
Figure 20:
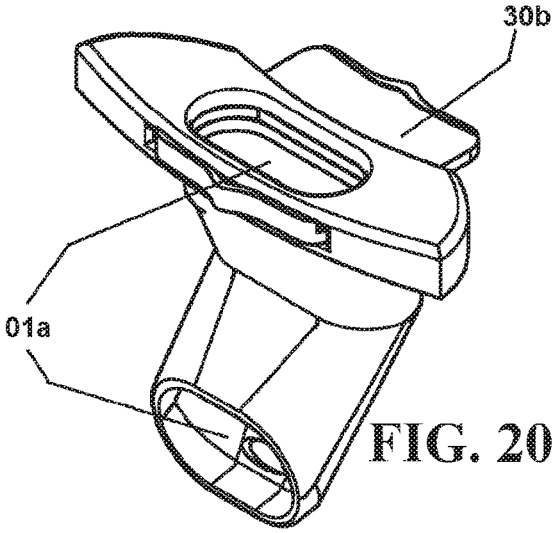
FIG. 20 is a tilted top down side view of a similar embodiment to FIG. 17 with its plug in the open position.
Figure 19:
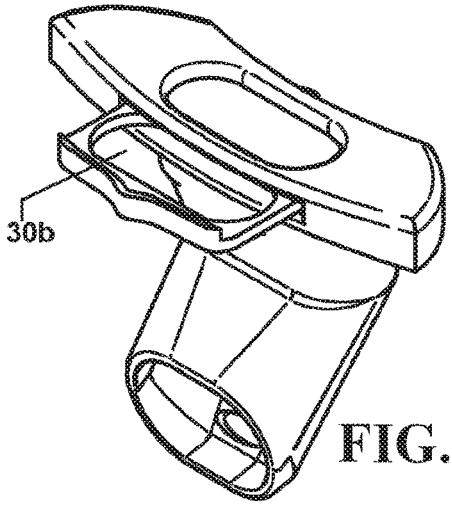
FIG. 19 is a tilted tap down side view of a similar embodiment to FIG. 17 with its plug in the closed position.
Figure 21:
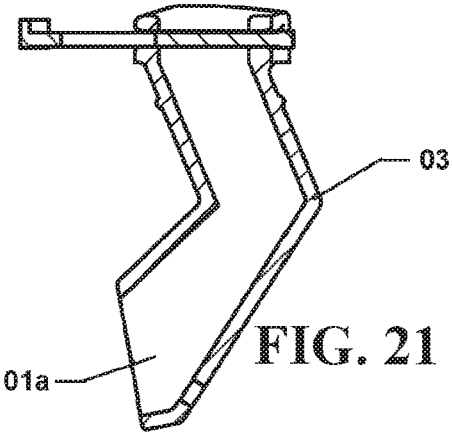
FIG. 21 is a cross section side angle of a similar embodiment to FIG. 17 with its plug in the closed position.

FIG. 17 through FIG. 21 illustrates a similar plug example, except with a slide plug 30*b* design instead of a fold plug 30 design. FIG. 19 and FIG. 20 show the slide plug 30*b*, in the closed position. Whereas FIG. 20 illustrates plug 30*b* in the open position. The slide plug is operated by sliding it forward or backwards, from the open position to allow liquid to flow through the sip-tube, to the closed position that plugs the sip-tube to block all ASSL. The closed position is preferred to extend off the front of the sip-tube, this way it could be slid to the open position with the mouth. A slightly elevated edge can be formed on the front and backside of the slide plug, to secure it in place, and to have something to grab on to with the finders, or mouth.

FIG. 3 is a side view of similar embodiment from FIG. 1, it illustrates a tubular shaped sip-tube 01 which comprises the main body of the sip-tube, it can be seen clearly on FIG. 1 through FIG. 21. The hollow tubular aspect 01*a* or flow-path, can be seen on the topside and bottom side of FIG. 2. This hollow tubular aspect, or flow-path 01*a* is better illustrated in FIGS. 4, 5, 10, 14, 20 and FIG. 21. These sip-tubes and flow-path's are designed to be secured to, and seal a sip-hole found on a container; or its lid, and then extend the sip-hole along a guided flow-path. Liquid can then flow through the hollow extended sip-hole, along the flow-path, in a more controlled and directed fashion.

Some of the flow-paths, as seen in most of the FIGS., with the exception of FIG. 5, 17, 18, 19, 20, and FIG. 21 are single path sip-tubes. Sip-tubes and their flow-paths help to deflect sloshing liquid from accidentally splashing out from a sip-hole.

The flow-path in FIG. 5 has one angle 03 formed along its path. FIG. 17 thru FIG. 21 have more then multiple angle 03 formed along their flow-paths. These angles create a labyrinth of flow-paths each designed to further deflect sloshing liquids. By directing liquid through two or more angled flow-paths, in opposing directions, it forces the liquid into a desired and controlled flow direction and rate. These additional angles help the further deflect and control liquid flow and rate.

These angles serve other functions as well; first it helps to lessen the accidental or undesirable sloshing and splashing of liquid flow in an upward direction, and in a forward/backward direction by blocking and redirecting multiple slosh directions into a controlled and desirable direction, they give the liquid more space to settle before it can exit the container, and they deflect the liquid back at itself before it ever enters the sip-tube. The triple angle such as that one FIG. 17 deflects sloshing liquid multiple times by the time it reaches the exit point on the topside of the sip-tube. For use in certain applications, a flow-path formed in two or more opposing directions works incredibly well because it forces the liquid to travel in the opposite direction it did from the previous angle, this kind of reverse angle sip-tube can sometimes deflect and control sloshing liquid better then a single flow-path.

Figure 14:
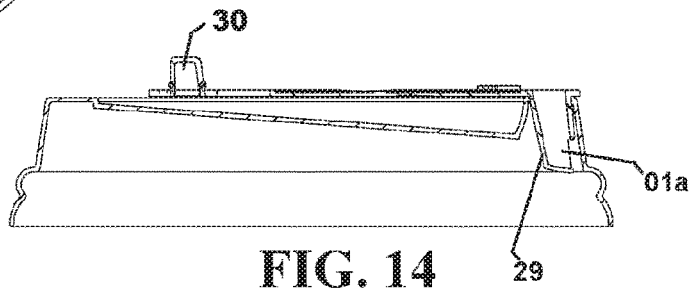
FIG. 14 is a cross section side view of an embodiment inserted into a beverage lid sip-hole in the open position.
Figure 15:
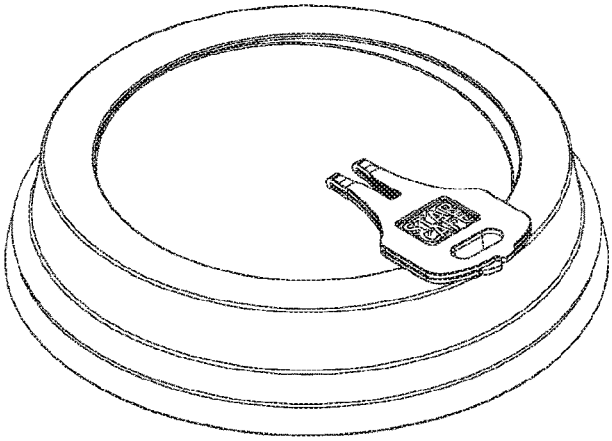
FIG. 15 is a top down tilted side view of an embodiment inserted into a beverage lid sip-hole in the folded-closed position.
Figure 16:
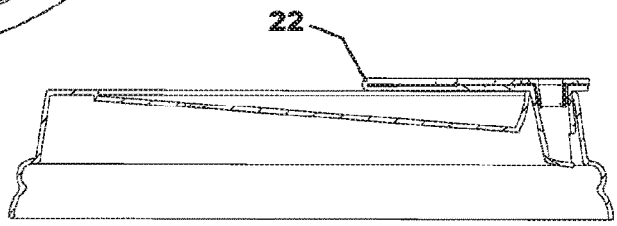
FIG. 16 is a cross section side view of an embodiment inserted into a beverage lid sip-hole in the folded-closed position.
Figure 17:
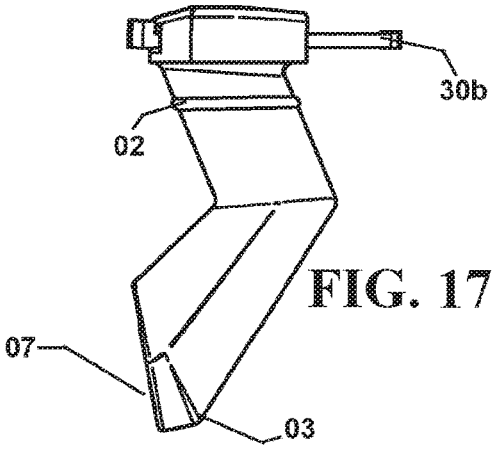
FIG. 17 is a side view of a triple angled flow-path embodiment with a slide plug.

FIG. 3 and FIG. 14 do not have multiple angles formed in their flow-paths, but they are angle formed 29 flow-paths. This single formed angled flow-path performs the same functions mentioned above, but does so in a simpler way, and these single angle designs can be manufactured by a broader range of processes, some that could be cheaper to produce then a multiple angled flow-path. Some embodiments such as those illustrated in FIG. 14 can be designed to rest just along the inside of a container or its lid after being secured to its sip-hole, and then limits to allow the desired flow rate to enter the flow-path through the cutout space between the container wall and the sip-tube. This design often works well for helping control ASSL.

Figure 12:
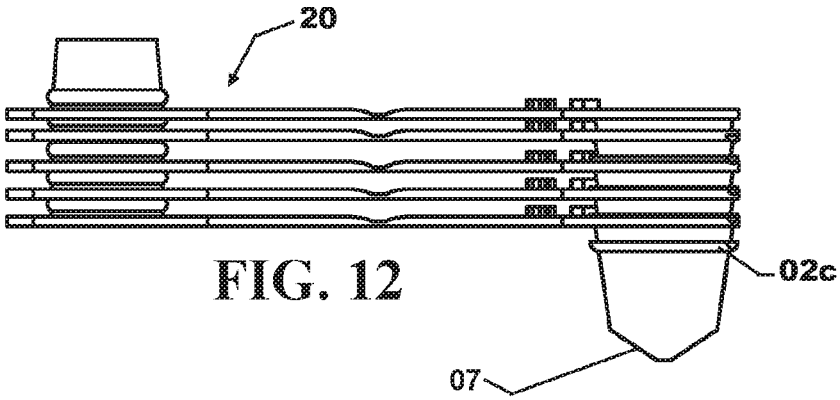
FIG. 12 is a side view of an embodiment of the present invention stacked upon itself.
Figure 13:
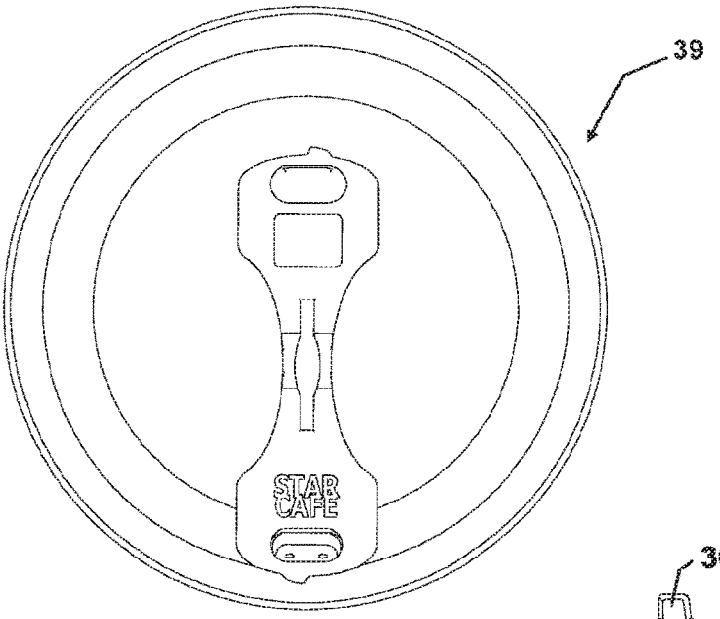
FIG. 13 is a top down view of an embodiment inserted into a beverage lid sip-hole in the open position.

The flow-path sip-tube deflection process further benefits when accompanied by a secondary exterior base angle 07, as seen in FIG. 5, 11, 12, and FIG. 17, formed at the exterior bottom side opening of the hollow flow-path. The base opening angle on the flow-path aides by further deflecting sloshing liquid before it ever enters the sip-tube. It also helps to guide liquid into the flow-path as the beverage container empties or the cup tilts. The slightest difference in this base angle might add some advantages in liquid sloshing in one direction, however it might lessen other advantages gained by the flow-path of slashing liquids in other directions. The preferred angle varies with size of the bottom opening hole and the number of angles along the flow-paths. The angle is not necessary, however it can be beneficial in some embodiments. It also aids and helps when trying to access all liquids within the container when pouring it and draining it. This exterior angle also aides in helping the sip-tube lay in an accommodating position to the internal angular shape of the container, thereby better improving suction and pouring abilities. An example of this is not illustrated within. The distance between the internal wall of the container and sip-tube also helps aide in the deflection of sloshing. The preferred distance varies with the viscosity of the liquid. FIG. 11 and FIG. 12 illustrates a double base angle 07, separated by a single exterior base side viscosity barrier 05. This double base angle combined with viscosity barrier 05 slows down sloshing liquid and channels it into a controlled and desired flow.

FIG. 3 illustrates a downward-curved base 23, this base works well in redirecting liquid. A base that works particularly well, but that is not illustrated is the opposite base of 23, it curves in an upwards direction. A double curved base works well at deflecting liquid and makes for easy draining of liquid entering the sip-tube. These curved bases perform a similar function as the angles in a flow-path do. They force liquid to be redirected in a controlled fashion, before allowing it to enter the sip-tube, this helps with ASSL.

One of the more convenient benefits or advantages of the extended sip-hole, is that a user does not need to tilt the container to access the liquid inside like they normally would. The sip-tube extension adds a suction like ability much like that of a mini-straw or sippy-cup to any basic cup/container once it is inserted. This ability helps in many ways, some of the more notable ones pertain to safety. By using a sip-tube, a person would no longer need to tilt the cup so they can take a sip. Standard coffee cups and lids will block your line of site when tilting them to take a sip, this can be dangerous while incredibly aggravating. Standard paper cups leak from the cup-crease when the cup is tilted. This is dangerous because it can stain, distract, or burn people while walking or driving. These problems are eliminated when using a sip-tube because a person does not need to tilt the cup very much to access the liquid inside when using a sip-tube, all they need to do is suck and then syphon/vacuum action will move the liquid up the sip-tube. It also allows a person to sip the beverage at a more controlled rate, increasing or decreasing liquid flow as desired. By adding a suction ability, a person could suck more liquid through the same sized hole faster, thereby accessing the liquid faster if desired. The sip-tube can also be formed to widen or stretch the hole it is inserted into, this helps to increase the flow of liquid whether pouring, sucking or sipping. This widening or stretching can be accomplished in several ways. One of the more obvious ways is by forming the sip-tube with a taper 04 as seen in FIG. 2, 11 and FIG. 18. The taper design 04 helps with the insertion and sizing process. By constructing a sip-tube with a smaller base then any hole it might inserted into, this allows for easy insertion no matter what shape or size a sip-hole might be. It can thereby stretch a differently shaped sip-hole to conform to the shape and size of the sip-tube that is inserted, or vice-versa. This adds several benefits; one is that is allows one shape and size sip-tube to work on most sip-holes, two it also widens a sip-hole to allow for more liquid to pass through, and three it helps to secure a snug and tight leak proof seal between the sip-tube and sip-hole. It would be advantageous to mention 18 the resting zone, as seen on all the attached drawings, but which is best illustrated on FIG. 10. This zone or region is where the sip-hole rests between the locking protrusions 02 and extended arm 08*c* and 08*d* as seen in FIG. 1 through FIG. 16. Much like standard beverage sip-hole plugs found at local coffee shops, this region can be formed to be slightly smaller then its neighboring upper and lower exterior flow-path, thereby allowing for perfect placement and a good seal between the sip-tube and sip-hole. FIG. 1 through FIG. 21 show a version of protruding extension 02, also called safety locking element 02*d* as seen in FIG. 10. 02*a*, 02*b* and 02*c* are subseries of 02, they are illustrated on most of the figures with slight modifications from 02. These elements work to secure a sip-tube in a snug, and proper functioning position within the sip-hole of the container or lid it is placed into. They work together in conjunction with 18 resting zone, to secure the best snug fit within a sip-hole. Due to the soft materials used to make most containers and their lids, a slightly oversized flow-path usually works best to help form good seal between a sip-tube and a sip-hole. Sip-tubes can stretch sip-holes and enlarge them, this is why a resting zone, positioned between two protrusion extensions, or locks, works well to secure a sip-tube properly and safely.

Figure 4:
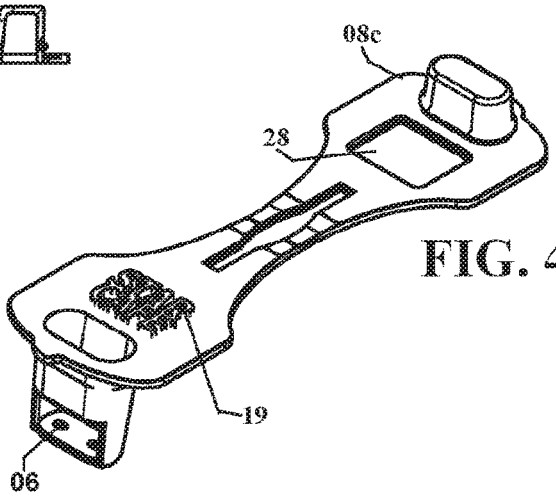
FIG. 4 is a top down tilted front side view similar embodiment from FIG. 1.
Figure 7:
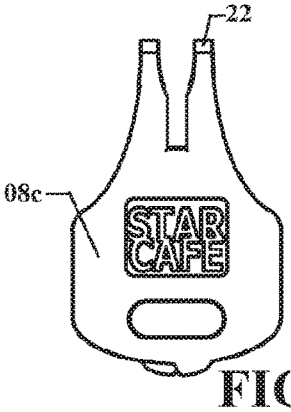
FIG. 7 is a top down view of a similar embodiment to that seen in FIG. 4, but in the folded-closed position, with the plug inserted into the sip-tube.

08*c* and 08*d* extended arm as illustrated on FIGS. 4, 7 and FIG. 10, are extended topside ramifications or versions of locking protrusion 02 and its subsets. These extended protrusions add several benefits, including a layer of safety in the prevention of chocking. They also ensure a more snug fit, seal and positioning of a sip-tube with a sip-hole. 08, 08*a* and 08*b* extend surface area where lips might come in contact with a lid, a container, or the sip-tube itself, thereby completing a closed loop seal for a good suction sip-tube insert device. An extended arm could be designed with a slightly curved shape 38 on FIG. 18 at the topside of its sip-tube, to match the shape of a person's lips. Additional locking and securing aspects can be achieved when using an extended arm by using an adhesive agent, this can be applied to the underside of any 08, or the topside of any 02 or their subseries, to allow them to be more securely attached for positioning and safety, or permanently adhered to a container or lid. The adhesive agent can consist of any standard or specialized agents, but preferably it would be made from edible compounds, possibly even a sugar-based agent, which could be activated when wet, or possibly licked to activate its stick much like a postage stamp. Another means for attaching the insert to a container or lid is illustrated in FIG. 4 as female lock cutout window 28. This can be any size or shaped latch and groove cutout, or any other type cutout insert lock mechanism used for situations like this. Whether its female or male, it makes no difference, as long as the container or lid is formed to receive it. This feature could be combined with 02 or 08 to fit snugly along the rim or edge of a container or its lid, thereby further securing it in position and forming a snug seal. These elements help because all sip-holes have slight variations in shape and sizing, so these elements help to make up for this shortcoming by sticking out further from the external edge of the flow-path. As stated above, this mechanism could be formed on an accompanying container or lid for attachment after manufacture of each component separately.

Each element should be constructed to prevent accidental release that could result in a person choking or ingesting the sip-tube. These additional elements are not necessary but they do add secondary levels of safety and convenience. These elements also serve to protect the insert from falling into the sip-hole. All of these protrusions aide to secure and lock the insert in place, whether by themselves, with adhesive aides, with locking elements, or in combination with other protruding extensions.

Figure 6:
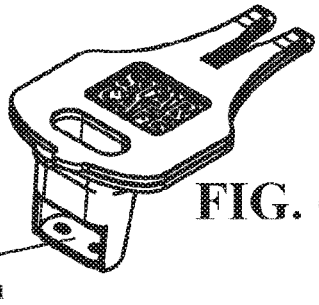
FIG. 6 is a top down tilted side view of a similar embodiment to that seen in FIG. 1, but in the folded-closed position, with the plug inserted into the sip-tube.

Another mentionable feature of 01, 02, 08 and their subseries is illustrated in FIG. 4 and FIG. 6 as 19 advertising and marketing aspect. Branding can be placed along these larger extensions and sip-tubes. This is advantageous for licensing and commercial use. Larger extensions such as these, and their longer/wider sip-tubes are big enough to use for branding. FIG. 6 illustrates a sip-tube-plug engaged in its folded/closed position, with window cutout 28 having a secondary use that allows advertising/branding aspect 19 to show on the sip-tube-plug whether it is in its open or closed position. 19 could be formed in a lifted or embossed and raised fashion so that it sits flush or extends beyond cutout 28 when the sip-tube-plug is in its folded/closed position.

Figure 9:
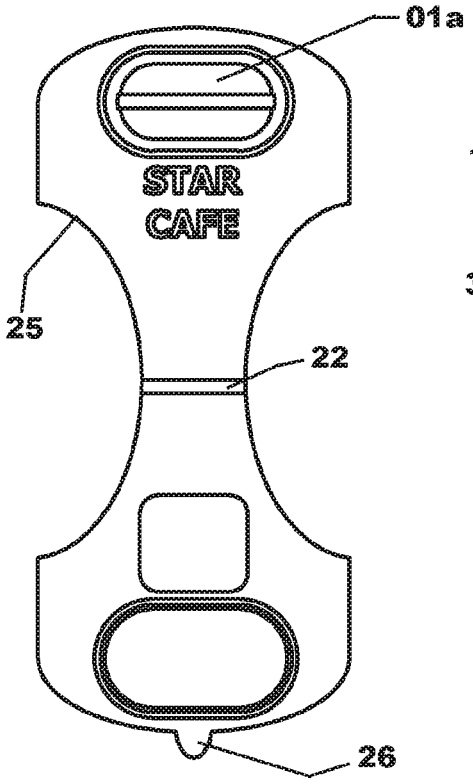
FIG. 9 is a top view of an embodiment of the present invention.

FIG. 9 illustrates finger-grab cutout 25. This shape and size can be altered to fit any size extension arm. This feature helps to cut back on material, costs and allows for easy handling. The same FIG illustrate another feature, finger lift 26, 26 adds an easy to grab latch to lift the sip-tube out from the sip-hole. 08 and its subseries can work as a grab latch as well. Crease fold 22 can be added to extension arm 08 subseries, this crease will help to allow an easy fold as illustrated in FIG. 7.

Another benefit gained from the sip-tube extension insert is that it seals the sip-hope, blocking the largest hole where heat escapes from. Therefore it works to keep the liquid inside the container, hot or cold, at its desired temperature for a longer period of time.

FIG. 10 and FIG. 11 illustrate viscosity barrier 05. 05 is an example of an external viscosity barrier. This barrier adds a filter-like feature that breaks up sloshing liquid and makes it harder for liquid to unintentionally enter the flow-path. The more viscous the liquid, the more deflection force is applied on the sloshing liquid. 05*a* as seen in FIG. 5 is an example of an internal viscosity barrier. This internal barrier works and performs the same function as an external one. In other embodiments not illustrated, a viscosity barrier is formed as both an exterior and interior barrier, running the full length of the flow-path, from the base opening to the top opening. Internal viscosity barriers such as 05*a* create channels or cambers. These chambers constrict the passage of liquid and help to better control liquid flow and direction. Multiple barriers of different shapes and sizes can be formed outside or inside a sip-tube to increase these benefits. Many barriers can be combined to form a screen-like membrane that liquid can pass through. This screen-like membrane can further deflect sloshing liquids. These viscosity barriers push against the viscous forces of liquids, further deflecting sloshing liquids and making it harder for unintentional liquids to escape from the topside of the sip-tube. The more of these barriers added, the better they deflect liquids. The angle of the barrier, direction they run, thickness, number placement of the barrier within or on the flow-path, and space between the inner walls of the cambers and flow-path are all important when considering desired flow control and liquid direction. These barriers can also be used as a support structure when using weaker, softer or edible materials when constructing a sip-tube.

FIG. 4, 6 and FIG. 18 illustrates the vented hole 06. The vented hole serves several notable purposes but is not limited to these; first it allows more liquid to flow into the flow-path for faster pour and suction, second it allows for cross flow of liquid which also aids in this but also deflects liquid, third it allows equal liquid flow distribution, forth it serves as en air hole for better liquid flow and pour. The difference in sizing, number of vented holes and position of these vented holes can further increase some of the benefits mentioned, and can add some additional flow and deflection benefits. By adding vented holes, the base side opening of a sip-tube can be designed to be smaller then sip-hole it will be placed in, but still allow for the same, or more liquid to enter the flow-path. Examples of that are illustrated with the tapered design 04 illustrated in FIG. 2. A good spot for placement of a vented hole is on the top side of sip-tube, situated between the wall of container, and the sip-tube, this is helpful when pouring out every last drop of liquid held in the container.

The inner flow-path of FIG. 5 and FIG. 10, have an interior protrusion 10 that can be seen in the cross-section view. This serves as a splashguard to deflect upward sloshing liquids within the flow-path. As a splashguard deflector, one or more of these protrusions could be beneficial along the inner flow-path of a sip-tube. They can be placed in multiple areas, sized and shaped in various configurations to deflect upward sloshing liquid. This element might be hard to manufacture using certain processes. Other methods would lend better to forming this feature.

Another feature to mention, which is not illustrated in the drawings, is a topside flow-path extension. Meaning the flow-path does not lay flush upon the sip-hole, container, or the topside of the sip-tube, as most of the illustrated versions do. It would extend the flow-path outwardly and above to topside. This could make for easier drinking, pouring, or sucking. It could also aide to improve the flow-path benefits and prevent additional splashing. This could also be used to aide in removing the sip-tube later, be it for recycling purposes or otherwise.

Figure 8:
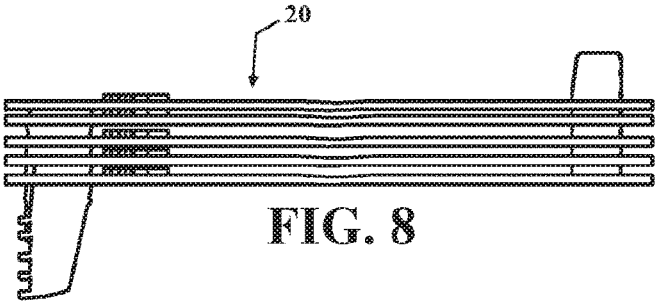
FIG. 8 is a side view of an embodiment of the present invention stacked upon itself.

Many of these features could be designed so that the sip-tube can be packaged and stacked 20 on top itself, as illustrated in FIG. 8 and FIG. 12. Some embodiments could be stacked together much like cup lids are, or post-it notes are. Some embodiments could even use adhesives that could be used to secure them so they could be easily stacked for retail usage.

FIG. 13, 14, 15 and FIG. 16 illustrate a sip-tube inserted into the sip-hole of beverage lid 39. This is a practical use of the sip-tube. The sip-tube can be designed and inserted to fit any container sip-hole, or lid. It would work well with box beverages and could be used to replace the common straw with a cheaper and eco-friendly solution.

A sip-tube-plug is used by inserting it into a sip-hole found on a container or a lid. After insertion, a sip-tube can be pushed or pressed into proper position. 02 locking protrusions and 08 extension arm and resting zone 18 will lock the sip-tube in place within the sip-hole, they will also help form a tight leak proof seal. Once properly inserted, the sip-hole will then be extended to the length of the sip-tube, the sip-hole with be enhanced, and the benefits discussed within this application will be achieved. The extension arm 08 could be folded and plug 30 could be locked within the sip-tube 01. Or slide plug 30*b* could be slid from the open position to the closed position at will to seal the sip-tube. Overall, this will make for a happier, more controlled and better splash-free drinking experience, while also being more economical and eco-friendly solution to the common spill-plug, or splash-stick.

In certain preferred embodiments not illustrated within the art work, a plug would be constructed as a pull or tear off seal, similar to those on beverage containers. Materials can be of any plastic, metal, polymer, paper, or the like of any known seals used by those trained in the art. The seal can be bonded, attached, adhered, glued, heat sealed, heat-bonded, built in mold, as few general options. This peel or pull off tab would be a most economical solution, while also adding a level and sanitary comfort while pressing the insert tube in place within the sip-hole.

Flow-paths are referenced many times within this applications, they can be found inside a tube, and can sometimes mean the outside of a tube.

Flanges is used with the claims section, and often refers to its traditional meaning, but also any bevel, lip, protrusion in or out.

Inlets are referenced in the claims, they are used with their general meaning, but also used to reference a configured cut, hole, opening, used to control or limit liquid and gas flow, in and out of the tube is found on. They will generally be found on the front side of many embodiments, but can have more then one, and also be found on the back side, and bottoms of the tube.

Sip-hole-plug extension can be constructed using partially or fully edible materials that could be eaten, dissolved into for flavoring, or pushed into drinks for flavor. This would cutback on waste and would add a nice flavor option to the sip-tube. Many materials would work for this, but a hard crystalline sugar or coating might be a good example. Other materials include paper, cardboard, plastics, polymers, compounds, mixtures and various combinations for these. Standard materials used in the container, cup, utensil and lid industries would work well. Manufacturing processes include those used by these industries as well, but no limited to these. The sip-tube could be extruded, formed, cast, press, cut, molded, to name a few common methods. Different materials, or combinations of materials, might call far other known manufacturing processes, or others yet to be discovered. A preferred method would likely be the cheapest. When using slide plug 30*b* cr a similar ramification, the sip-tube and slide plug element would likely be manufactured separately, then assembled. There are some known methods that could be used to manufacture both pieces at the same time, without the need for assembly. Newer scented materials have become popular in the beverage industry as of late. The sip-tube-plug would farewell being designed from a flavored, and or scented material. Visual temperature/thermal monitoring materials have become popular recently as well in the beverage industry. A sip-tube-plug that changes color with temperature would be advantageous for safety and best flavor drinking temperature.

After extensive testing with the sip-tube-plug, it has been shown that a simple short, straight, hollow flow-path works incredibly well in combatting the better half of the ASSL of sloshing liquid from a sip-hole. Many of the additional elements disclosed above, add further layers of protection against this all to common problem. While a simple short sip-tube-plug inserted and secured onto a sip-hole is the base for this application, more dynamic additions like some of those illustrated within this application compound its benefits.

Although the description above contains much specificity, these should not be construed as limiting the scope of the embodiments but as merely providing illustrations of some of the presently preferred embodiments. Many other beneficial results can be attained by applying the disclosed invention in a different manner or by modifying the invention as was described to show several possibilities.

The scope of this application should not be solely determined by the examples given but also by the appended claims and their legal equivalents as well.

It is claimed:

1. A sip-hole improvement insert device comprising:

a flange;

a single hollow tubular body extending only downward from the flange, the single hollow tubular body comprising a first downward portion that defines a flow-path, wherein the single hollow tubular body is sized to extend into a sip-hole, wherein the flange comprises a planar layer configured to lay flush with a surface surrounding the sip-hole, and wherein the single hollow tubular body further comprises a raised locking protrusion ring formed along an outer surface of the single hollow tubular body for securing the sip-hole improvement insert device with a sip-hole;

a plug element extending upward from the flange and positioned distally along the flange from the single hollow tubular body for closing the single hollow tubular body, wherein the plug element comprises a corresponding locking protrusion;

a crease positioned midway and transversely across the flange, wherein the insert device is foldable along the crease such that the plug is insertable into the single hollow tubular body; and a resting zone formed along an outside surface of the single hollow tubular body adjacent to the flange for securing the device with a sip-hole, wherein the raised locking protrusion ring, the corresponding locking protrusion, and the resting zone function cooperatively to secure a snug fit in the sip-hole.

2. The sip-hole improvement insert device of claim 1, wherein the single hollow tubular body is at least partially tapered.

3. The sip-hole improvement insert device of claim 1, further comprising at least one additional downward portion of the single hollow tubular body that defines at least one additional flow-path.

4. The sip-hole improvement insert device of claim 3, wherein the single hollow tubular body further comprises:

at least one vented hole positioned along the first downward portion of the single hollow tubular body, wherein the at least one vented hole defines a path for fluid and gas communication.

5. The sip-hole improvement insert device of claim 4, wherein the at least one vented hole is positioned proximate with a wall of a container.

6. The sip-hole improvement insert device of claim 1, wherein the single hollow tubular body further comprises:

an angled base opening at a distal end of the single hollow tubular body for deflecting a sloshing liquid.

7. A method of improving a beverage lid comprising:

providing a sip-hole improvement insert device, the sip-hole improvement insert device comprising:

a flange;

a single hollow tubular body extending only downward from the flange, the single hollow tubular body comprising a first downward portion that defines a flow-path, wherein the single hollow tubular body is sized to extend into a sip-hole, wherein the flange comprises a planar layer configured to lay flush with a surface surrounding the sip-hole, and wherein the single hollow tubular body further comprises a raised locking protrusion ring formed along an outer surface of the single hollow tubular body for securing the sip-hole improvement insert device with a sip-hole;

a plug element extending upward from the flange and positioned distally along the flange from the single hollow tubular body for closing the single hollow tubular body; and a crease positioned midway and transversely across the flange, wherein the insert device is foldable along the crease such that the plug is insertable into the single hollow tubular body, wherein the plug element comprises a corresponding locking protrusion; and a resting zone formed along an outside surface of the single hollow tubular body adjacent to the flange for securing the device with a sip-hole, wherein the raised locking protrusion ring, the corresponding locking protrusion, and the resting zone function cooperatively to secure a snug fit in the sip-hole; and inserting the sip-hole improvement insert device into the sip-hole of the beverage lid.

8. A system of improving a beverage lid comprising:

a beverage lid with a sip-hole;

a sip-hole improvement insert device, the sip-hole improvement insert device comprising:

a flange;

a single hollow tubular body extending only downward from the flange, the single hollow tubular body comprising a first downward portion that defines a flow-path, wherein the single hollow tubular body is sized to extend into a sip-hole, wherein the flange comprises a planar layer configured to lay flush with a surface surrounding the sip-hole, and wherein the single hollow tubular body further comprises a raised locking protrusion ring formed along an outer surface of the single hollow tubular body for securing the sip-hole improvement insert device with a sip-hole;

a plug element extending upward from the flange and positioned distally along the flange from the single hollow tubular body for closing the single hollow tubular body; and a crease positioned midway and transversely across the flange, wherein the insert device is foldable along the crease such that the plug is insertable into the single hollow tubular body, wherein the plug element comprises a corresponding locking protrusion; and a resting zone formed along an outside surface of the single hollow tubular body adjacent to the flange for securing the device with a sip-hole, wherein the raised locking protrusion ring, the corresponding locking protrusion, and the resting zone function cooperatively to secure a snug fit in the sip-hole; and a compatible container to receive the beverage lid with the sip-hole improvement insert device.

9. The sip-hole improvement insert device of claim 1, wherein the single hollow tubular body further comprises:

a viscosity barrier positioned across a downward opening of the single hollow tubular body and extending upward from the downward opening.

* * * * *